United States Patent [19]

Van Ess

[11] 4,335,422

[45] * Jun. 15, 1982

[54] ELASTIC LIGHT MOUNTING TAPES

[75] Inventor: John C. Van Ess, Chicago, Ill.

[73] Assignee: Walter A. Ross, Schiller Park, Ill.

[ * ] Notice: The portion of the term of this patent subsequent to Jan. 6, 1998, has been disclaimed.

[21] Appl. No.: 171,321

[22] Filed: Jul. 23, 1980

Related U.S. Application Data

[63] Continuation of Ser. No. 14,225, Feb. 22, 1979, abandoned, which is a continuation-in-part of Ser. No. 966,439, Dec. 4, 1978, Pat. No. 4,244,014.

[51] Int. Cl.[3] ..... F21V 21/00; F21V 21/08

[52] U.S. Cl. ..... 362/388; 362/249; 362/396; 362/433; 362/430; 362/806; 362/810; 362/429

[58] Field of Search ..... 362/249, 250, 251, 252, 362/387, 407, 806, 388, 396, 810, 429, 430

[56] References Cited

U.S. PATENT DOCUMENTS

| | | | |
|---|---|---|---|
| 1,652,825 | 1/1929 | Hechinger . | |
| 1,820,706 | 8/1931 | Law . | |
| 2,280,901 | 5/1942 | Eddy . | |
| 2,298,089 | 10/1942 | Veenboer . | |
| 2,318,375 | 5/1943 | Copeman . | |
| 2,676,711 | 4/1954 | Jardim . | |
| 3,011,049 | 11/1961 | Kinghorn . | |
| 3,127,019 | 3/1964 | Von Meyer . | |
| 3,189,310 | 6/1965 | Trueson . | |
| 3,275,818 | 9/1966 | Campbell . | |
| 3,540,687 | 11/1970 | Cuva | 248/316 |
| 4,128,863 | 12/1978 | Premetz | 362/249 |
| 4,244,014 | 1/1981 | Van Ess | 362/249 |

FOREIGN PATENT DOCUMENTS 1300204 2/1968 France .

*Primary Examiner*—Irwin Gluck

*Attorney, Agent, or Firm*—Hill, Van Santen, Steadman, Chiara & Simpson

[57] ABSTRACT

Light mounting tapes receiving electric light sockets of the type commonly used for Christmas decorations are provided in elastic form so that they may be stretched as desired between mounting fasteners, as for example around a door or window frame. The tapes provide a plurality of receptacles along their lengths. The tapes can be furnished in segmented lengths and easily secured together in series to provide a desired overall length. The elastic properties of the tapes facilitate stretching them into taut condition for fixedly positioning the electric lights mounted in the receptacles thereof.

12 Claims, 5 Drawing Figures

ELASTIC LIGHT MOUNTING TAPES

RELATED APPLICATION

This application is a continuation of my copending application entitled: "ELASTIC LIGHT MOUNTING TAPES", filed Feb. 22, 1979, U.S. Ser. No. 014,225 now abandoned which is a continuation-in-part of my copending application entitled "LIGHT MOUNTING TAPES", filed Dec. 4, 1978, U.S. Ser. No. 966,439, now U.S. Pat. No. 4,244,014.

BACKGROUND OF THE INVENTION

1. Field of the Invention

The present invention relates to devices for displaying electric lamps in windows and elsewhere.

2. Description of the Prior Art

Non-flexible electric lamp display devices, such as U.S. Pat. No. 1,652,825 are known in the art. Such devices, however, do not possess the advantage of being able to be mounted around irregularly shaped windows or eaves. Those devices also utilize metallic clips to hold the lights in place, rather than elastic bands or retaining strips.

Individual clips, such as that disclosed in U.S. Pat. No. 3,275,818 must be individually mounted and cannot be removed and stored with the lights remaining fixed therein.

A light socket retaining means such as U.S. Pat. No. 3,540,687 has a portion thereof which may be retained about and stored with the light sockets, but still requires individual mounts which receive the clip which must be individually affixed to the structure to be illuminated.

SUMMARY OF THE INVENTION

In my aforesaid parent application Ser. No. 966,493 I have disclosed and claimed flexible mounting tapes for electric light sockets adapted to be strung along window and door frames to mount Christmas tree lights and the like at spaced intervals. These tapes were relatively non-stretchable and cooperated with retainer bands to form the receptacles for the light sockets.

According to the present invention the mounting tapes are furnished in elastic form to be stretched taut along the doorway, window frame or the like to be illuminated with the electric lights carried thereby. This elasticity of the tapes facilitate installation by the use of various fasteners and stretching of the tapes not only holds them firmly in installed positions but also places tension on the receptacles or pockets receiving the sockets of the electric light fixtures to more firmly secure them in position.

Another feature of the present invention includes the provision of short elastic tape lengths which are easily mounted in series to provide a string of a desired length. Ring type connectors can be used to unite the tape sections in end-to-end series relation.

Another feature of the invention is the provision of tape sections in closed loop form with fasteners or seams dividing the closed loop into a series of pockets to receive the light bulb sockets.

Another feature of the invention is to provide the closed loop elastic tape sections with internal abutments that will divide the section into pockets when the tape is tensioned.

It is then an object of this invention to provide light mounting tapes of the type disclosed and claimed in my aforesaid parent application Ser. No. 966,493 in elastic form to accommodate stretching for tight positioning of the tapes between fasteners and around electric light sockets.

A further object of the invention is to provide electric light mounting tapes in the form of closed loop elastic segments which are easily united in series to form a string of desired length.

Other and further objects and features of this invention will become apparent to those skilled in this art from the following detailed description of the drawings.

DESCRIPTION OF THE PREFERRED EMBODIMENTS

Figure 2:
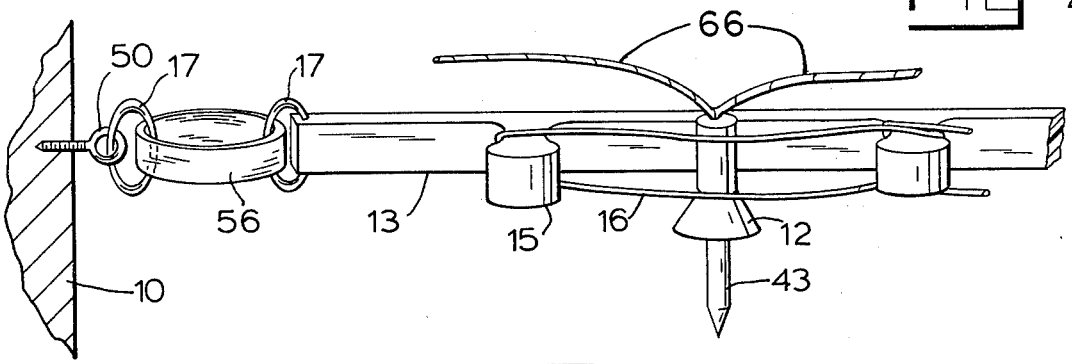
FIG. 2 is a fragmentary perspective view of an extruded rib light mounting tape with an elastic mounting means according to this invention.

In the form of the invention illustrated in FIG. 2 a non-elastic strip or tape 13 has a plurality of longitudinally spaced flanged ribs 15 extending from one face thereof and receiving an elastic retaining band 16 therearound so as to provide a pocket or receptacle for receiving a light bulb socket 12 carrying a light bulb 43 as described in my aforesaid parent application Ser. No. 966,493. However, according to this invention, the strip 13 is mounted in a taut condition between structures such as a door frame 10 to be illuminated by means of an elastic looped band 56 connected to one end of the strip 13 by a ring 17 and connected to a fastener 50 carried by the structure 10 by a second ring 17. The rings 17 and other connecting rings, described below, can be made of rigid or semi-rigid materials such as plastic or metal and need not be identical in shape to that shown in the drawings. This elastic band 56 can be stretched as desired to hold the strip in a taut firm position in the structure 10. The fastener 50 may take the form of a eye-type screw, or other suitable shapes.

The elastic band 56 can be formed of any suitable resilient material such as rubber, elastic-type synthetic plastics materials and the like.

Figure 1:
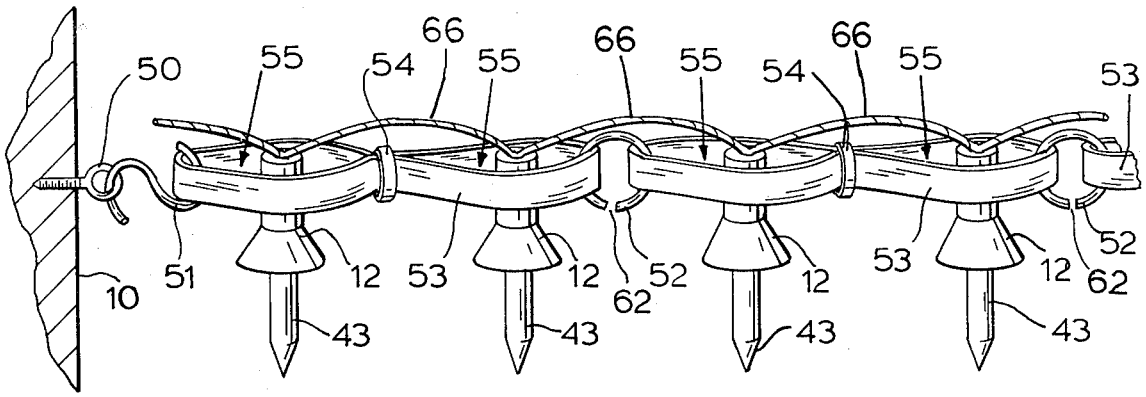
FIG. 1 is a fragmentary perspective view of an elastic light mounting tape and attachment fasteners of my invention.

In another embodiment of the invention shown in FIG. 1 a plurality of elastic bands 53 are connected together in series by means of a plurality of rings 52. The bands 53 may be comprised of any suitable elastic material, such as rubber or synthetic plastic elastic material or the like. Each of the rings 52 has a gap 62 so that the bands 53 may be releaseably engaged with the ring. Alternating bands 53 and rings 52 may thus be strung together in series to form a tape of any desired length.

A sectioning band 54, comprised of non-flexible material, extends around the elastic band 53 to divide the band 53 into a number of receptacles or pockets 55. Although a single sectioning band 54 is shown in FIG. 1 dividing the elastic band 53 into two receptacles 55, it will be understood that depending upon the size of the elastic band 53, a number of sectioning bands 54 may be utilized to divide the elastic band 53 into any desired number of receptacles 55.

A light socket 12 containing a light bult 43 is received in each receptacle 55. One of the bands 53 which terminates the mounting device engages one end of an S-hook 51, a second end of which engages and eye-type screw 50 which is mounted in the structure 10 to be illuminated.

Figure 3:
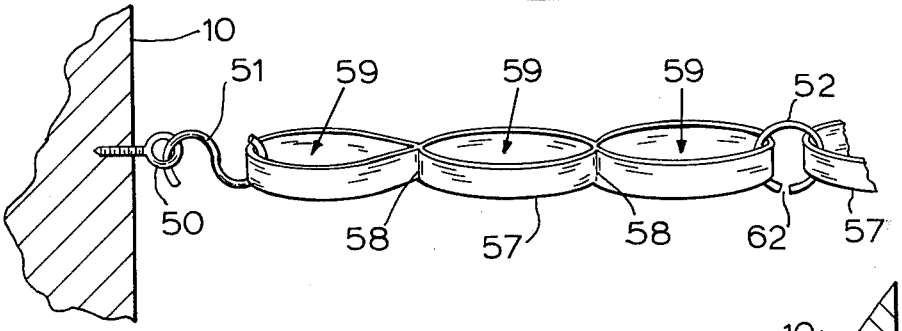
FIG. 3 is a fragmentary perspective view of a modified elastic light mounting tape of this invention with sections formed by seams.

A further embodiment of the invention is shown in FIG. 3, wherein a plurality of elastic bands 57 are held together by a number of rings 52. As in the embodiment in FIG. 1, the rings 52 have a gap 62 therein so that the bands 57 may be releaseably connected by means of the rings 52 to form a mounting device of any desired length. The band 57 may be comprised of any suitable elastic material, such as rubber, synthetic plastic elastic material, or the like.

The elastic band 57 is divided into a selected number of receptacles or pockets 59 by means of seams 58 joining sides of the band 57 together. One end of an S-hook 51 engages an end of one of the bands 57, and a second end of the S-hook 51 engages an eye-type screw 50 or other type screw or fastener which is mounted in the structure 10 to be illuminated.

Figure 4:
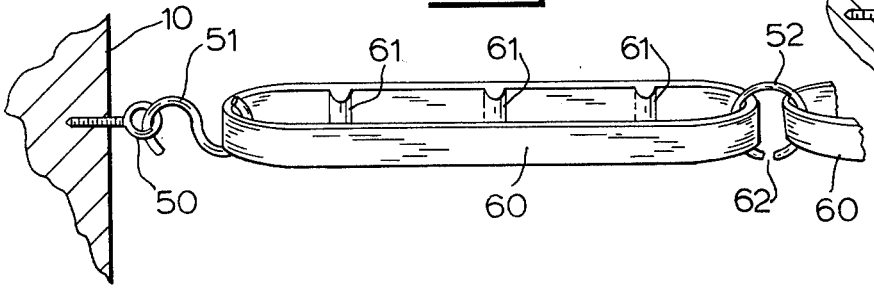
FIG. 4 is a fragmentary perspective view of a further modified elastic light mounting tape with internally disposed ribs according to this invention.

Another embodiment of the invention is shown in FIG. 4 comprised of a plurality of elastic bands 60 which are held together in general alignment by a plurality of rings 52 passing through the band 60. As in the other embodiments, the ring 52 has a gap 62 therein for releaseably holding the bands 60 so that a mounting device of any desired length may be formed by alternating bands 60 and rings 52. The band 60 may be composed of any suitable elastic material, such as rubber, synthetic plastic elastic material, or the like.

A portion of the interior of the elastic band 60 has a number of ribs or abutments 61 extruded thereon, disposed at equal intervals. The ribs 61 extend the entire thickness of the interior of the band 60. The interior of the band 60 opposite the ribs 61 is smooth. One end of an S-hook 51 engages the band 60, and a second end of the S-hook 51 engages an eye-type screw 50 which is mounted in the structure 10 to be illuminated. When the band 60 is tightly stretched, the ribs 61 abut the opposite smooth portion of the interior of the band 60 forming a plurality of socket receiving and retaining receptacles.

Figure 5:
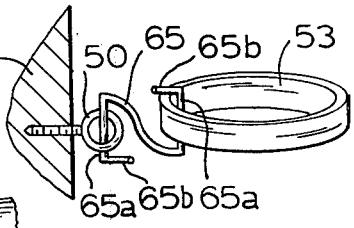
FIG. 5 is a fragmentary perspective view of the tape with a modified type of S-hook.

As shown in FIG. 5, a modified form of S-hook 65 can be utilized to secure any one of the bands 53,56,57, or 60 to a fastener such as the eye-type screw 50. The modified S-hook 65 has a Z shape with opposed flat legs 65*a* so that a band such as the flat faced band 51 engaging the hook 65 will mate with and abut flat against the portion 65*a* without bending or wrinkling. The ends of the flat legs 65*a* have upturned flanges 65*b* to retain the band 51 and eye screw 50.

Each of the sockets 12 is joined to an adjacent socket by an electrically conducting wire 66. In each of the embodiments, the wire 66 extends externally of the pockets which individually receive the sockets 12 to permit easy interchanging of the sockets and external access of the pockets. Each of the pockets releasably though snugly receives a light socket of the string connected by the wire 66 to fixedly project the sockets 12 laterally of the elastic bands 53 or 60 or the tape 13. The pockets open laterally of the tape, are elastic and stretched to receive the sockets 12. In those embodiments where the pocket forming portions of the tape are elastic, a stetching of the tape by the fasteners will tighten the pockets on the sockets. The sockets 12 are thus tightly retained by the pockets to such a degree that the lights will not shift.

Although various modifications and changes may be suggested by those versed in the art, it should be understood that I wish to embody within the scope of the patent warranted hereon all such modifications and changes as reasonably and properly come within the scope of my contribution to the art.

I claim as my invention:

1. A mounting device for electric light sockets adapted to be strung along window frames and the like to position light bulbs in the sockets for display in the window or the like which comprises a tape having an elastic section adapted to be stretched to hold the tape in a taut condition along the window or the like, means along the length of said tape defining externally accessible pockets for releasably receiving the electric light sockets to project electric lights carried by the sockets laterally from the tape, and fastener means for securing said tape to said window frame or the like and cooperating with said elastic tape section to maintain the tape in a taut condition.

2. A mounting device for a string of electric light sockets connected by current-supplying wires adapted to be strung along window frames and the like to position light bulbs in the sockets for display in the window or the like which comprises externally accessible closed loop elastic tape sections, means for connecting said sections in end-to-end series relation to provide a tape of the desired length, and means dividing the loops enclosed by said sections into a plurality of pockets for releasably receiving the light bulb sockets transversely therein with said wires spanning adjacent pockets externally of said loops.

3. The mounting device of claim 2 wherein said means connecting said sections in end-to-end series relation is a ring having a gap for releaseably engaging said ring with adjacent sections.

4. The mounting device of claim 2 wherein said means for dividing said sections into a plurality of pockets is a plurality of rigid bands surrounding said sections in a plane generally perpendicular to a longitudinal axis of said device.

5. The mounting device of claim 2 wherein said means for dividing said sections into a plurality of pockets is a plurality of seams joining opposite sides of said section, each of said seams disposed in a plane generally perpendicular to a longitudinal axis of said device.

6. The mounting device of claim 2 wherein said means for dividing said sections into a plurality of pockets is a plurality of abutments on a side portion of the interior of said sections, each of said abutments disposed generally perpendicularly to a longitudinal axis of said device and abutting the opposite side of said section to define light socket receiving pockets therebetween.

7. The mounting device of claim 1 wherein the elastic tape section is a closed loop and the fastener means are rings at the ends of the loops.

8. The mounting device of claim 1 wherein the elastic section is a flat faced band and the fastener means is a Z-shaped hook with a flat leg mating with and abutting the flat face of the band.

9. The mounting device of claim 8 wherein the flat leg of the fastener has an upturned end flange retaining the band on the leg.

10. A mounting device for a string of electric light sockets connected by current-supplying wires adapted to be strung along window frames and the like to fixedly position light bulbs in the sockets for display in the window or the like which comprises a tape having an elastic section adapted to be stretched to hold the tape in a taut condition along the window or the like, means along the length of said tape defining a plurality of longitudinally spaced pockets opening laterally of the tape and being externally accessible for releasably and snugly receiving the electric light sockets of the string to fixedly project electric lights carried by the sockets laterally from the tape with the wires spanning adjacent pockets externally of the tape and fastener means for securing said tape to said window frame or the like cooperating with said elastic tape section to maintain the tape in a taut condition.

11. The device of claim 10 when the pockets are elastic and are stretched to receive the sockets.

12. The device of claim 11 wherein the fastener means stretches the tape and tightens the pockets on the sockets.

* * * * *